United States Patent [19]

Garrison

[11] Patent Number: 4,697,295

[45] Date of Patent: Oct. 6, 1987

[54] FLOOR CLEANING DEVICE

[76] Inventor: Gail W. Garrison, 3250 E. De Bazan Ave., St. Petersburg Beach, Fla. 33706

[21] Appl. No.: 916,797

[22] Filed: Oct. 8, 1986

[51] Int. Cl.[4] ..... A47L 13/18; A47L 13/282

[52] U.S. Cl. ..... 15/227; 15/215; 36/136

[58] Field of Search ..... 15/208, 209 R, 215, 15/216, 227; 36/7.6, 7.7, 136

[56] References Cited

U.S. PATENT DOCUMENTS

| | | | |
|---|---|---|---|
| 1,478,914 | 12/1923 | Ritzenthaler | 15/227 |
| 2,006,708 | 7/1935 | Benedict | 15/227 X |
| 2,855,622 | 10/1958 | Tixerant | 15/227 |
| 3,362,775 | 1/1968 | Muecke | 15/227 X |
| 3,460,182 | 8/1969 | Grande | 15/227 |

FOREIGN PATENT DOCUMENTS

| | | | |
|---|---|---|---|
| 990065 | 9/1951 | France | 15/227 |

*Primary Examiner*—Chris K. Moore

*Attorney, Agent, or Firm*—Ronald E. Smith

[57] ABSTRACT

A floor cleaning device the use of which does not require the use of one's hands. The device is a towel-like member provided with a pair of pocket members on its top and bottom surfaces. Each of the pocket members is specifically configured and dimensioned to slideably receive therein a human foot so that one desiring to clean a floor may insert one's feet in different ones of the pockets and walk across the support surface to be cleaned after having applied a suitable cleaning solution to the support surface. The act of walking constitutes scrubbing of the support surface.

3 Claims, 2 Drawing Figures

FLOOR CLEANING DEVICE

BACKGROUND OF THE INVENTION

1. Field of the Invention

This invention relates, generally, to floor cleaning devices and more particularly relates to human-powered floor cleaning devices.

2. Description of the Prior Art

A search of United States patents that was conducted prior to the filing of this disclosure indicated that the following patents have heretofore been awarded in the field of this invention:

U.S. Pat. No. 1,569,854 to Doerr (1926) shows a hand-worn cleaning mitt; U.S. Pat. No. 1,975,260 to Englander (1934) also shows a hand-worn item; U.S. Pat. No. 2,323,098 to Mintzes and others (1943) shows a reversible shoe shine kit; U.S. Pat. No. 3,761,991 to Moss (1973) shows a floor cleaning device that is attachable to a mop and U.S. Pat. No. 4,224,712 to Black and others (1980)shows a cleaning device that is worn as an apron.

The hand worn mitts of the prior art do not allow the user thereof to remain standing during the floor-cleaning process, and more importantly, do not allow the person cleaning the floor to apply his or her hands to tasks other than the cleaning job.

The mops of the prior art do allow the user thereof to remain standing, but the hands of the user must be dedicated to manipulation of the mop thereby excluding the performance of other tasks during the mopping procedure.

There is a need for a floor cleaning device that allows the hands of the user thereof to remain free for the performance of other tasks, but a device that could fulfill such need does not appear in the art.

SUMMARY OF THE INVENTION

The article of manufacture that is the subject of this invention is a modified towel, in its preferred embodiment. The modification includes the addition of a pair of foot-receiving pockets provided on each surface of the towel, sufficiently spaced so that when one slides one's feet into the pockets, one can walk in a normal manner or in a shuffle if desired, without fear of tripping. The pockets are preferably closed at the toe end thereof and open at the opposite end to receive a foot therein.

It is therefore understood that the primary object of this invention is to provide a floor cleaning device the use of which does not occupy the user's hands.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

Like reference numerals refer to similar parts throughout the several views of the drawings.

DETAILED DESCRIPTION OF THE PREFERRED EMBODIMENTS

Figure 1:
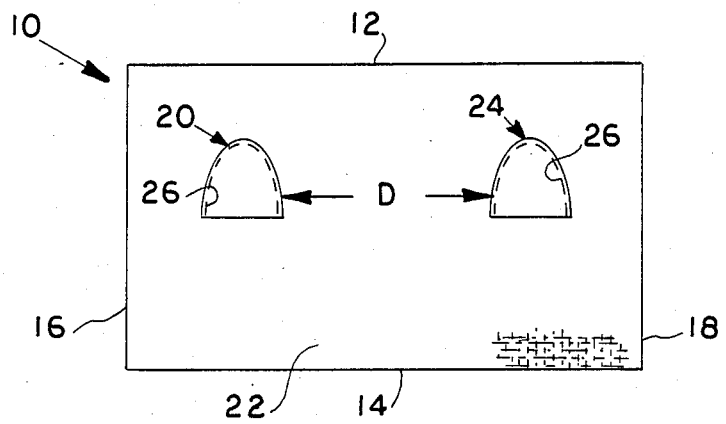
FIG. 1 is a plan view of a first embodiment of the invention.

Referring now to FIG. 1, it will there be seen that the preferred embodiment of the invention is designated 10 as a whole.

The item 10 is formed of an absorbent material, and in a contemplated commercial embodiment of the invention, a terry cloth-like material would be used. Thus, the device 10 should be understood to be of planar configuration, having a nominal thickness and being formed of a flexible material.

The device 10 is shown as having a rectangular configuration when seen in plan view, but other shapes are within the scope of the invention. Specifically, the device 10 could take the form of an oval, a diamond, a triangle, a trapezoid and other forms.

In the embodiment of FIG. 1, the device has a transversely disposed leading edge 12, a longitudinally spaced trailing edge 14 parallel to such leading edge, and a pair of longitudinally disposed, transversely spaced apart and parallel edges 16, 18.

A first foot-receiving pocket member 20 is provided on the top surface 22 of the device, and a second foot-receiving pocket member 24 is provided in laterally spaced relation thereto, also on the top surface of the device. The distance D between the pocket members 20, 24 is preselected to be at least equal to the stride of a long-striding individual so that when the feet of such an individual are slideably disposed within different ones of the pocket members, such individual can walk freely.

The pocket members have a floor portion defined by the sheet material of which the device 10 is formed, which sheet material is hereinafter referred to as the base means. The balance of each pocket member is formed by sewing or otherwise fixedly securing the peripheral edges of a piece of material, which material should also be of towel-like texture, to said base means. In both of the FIGS., the phantom lines 26 indicate the sewing lines or other attachment lines. The toe or forward end of each pocket is closed by the sewing operation and the opposite end is left open (unsewed) so that a foot can slidingly enter such pocket in the manner suggested by the single-headed directional arrows appearing in the FIGS.

Figure 2:
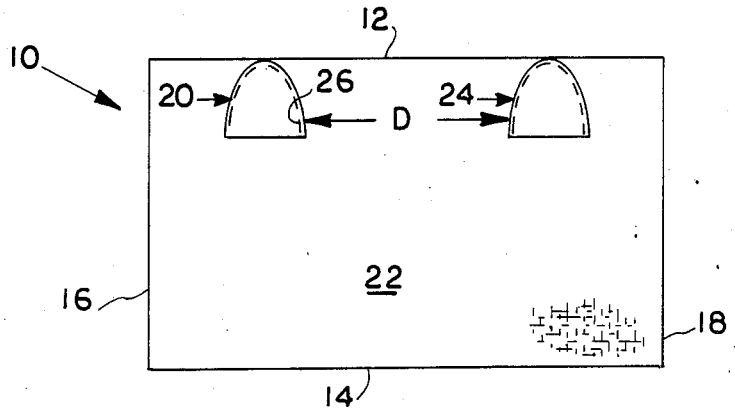
FIG. 2 is a plan view of a second embodiment of the invention.

In the embodiment of FIG. 1, the pocket members 22 and 24 are disposed in substantially equidistantly spaced relation to the leading and trailing edges 12, 14 of the device, whereas in the embodiment of FIG. 2, the pocket members are positioned closely to the leading edge.

Although surface 22 has been referred to herein as the "top" surface of the subject cleaning device, it should be understood that still further embodiments of the invention contemplate the provision of pocket members 20, 24 on the bottom surface of the device as well. Thus, both FIGS. should be understood as depicting bottom as well as top surfaces. The provision of pocket members on both surfaces of a towel-like cleaning device allows the user thereof to reverse the device when the downward surface thereof has exhausted its cleaning capability.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An article of manufacture useful for cleaning floors, comprising:

a flat, flexible, absorbent cleaning member of predetermined configuration;

said cleaning member having a top surface and a bottom surface;

a pair of substantially laterally spaced pocket members formed on said top surface;

each of said pocket members being of sufficient dimension to slideably receive therein at least a portion of a human foot;

said pocket members being spaced sufficiently far apart to allow an individual with a foot in each pocket to walk without tripping, and a pair of substantially laterally spaced pocket members formed on the bottom surface of said cleaning member;

whereby the cleaning member may be inverted and its use continued when one surface thereof has exhausted its cleaning capacity.

2. The article of claim 1, wherein said cleaning member is of generally rectangular configuration, wherein said cleaning member has a transversely disposed leading edge and a longitudinally spaced trailing edge parallel thereto, and wherein said pocket members are disposed adjacent said leading edge.

3. The article of claim 1, wherein said cleaning member is of generally rectangular configuration, wherein said cleaning member has a transversely disposed leading edge and a longitudinally spaced trailing edge parallel thereto, and wherein said pocket members are disposed substantially intermediate of said leading and trailing edges.

* * * * *